US006843247B2

(12) United States Patent
Frye et al.

(10) Patent No.: US 6,843,247 B2
(45) Date of Patent: Jan. 18, 2005

(54) PORTABLE LIQUID OXYGEN UNIT WITH MULTIPLE OPERATIONAL ORIENTATIONS

(75) Inventors: Mark Robert Frye, Bloomington, IN (US); Leonardo Shiki Toma, Indianapolis, IN (US); Richard Scott Remes, Chesterfield, MO (US)

(73) Assignee: Mallinckrodt Inc., St. Louis, MO (US)

( * ) Notice: Subject to any disclaimer, the term of this patent is extended or adjusted under 35 U.S.C. 154(b) by 0 days.

(21) Appl. No.: 10/358,150

(22) Filed: Feb. 5, 2003

(65) Prior Publication Data

US 2003/0136403 A1 Jul. 24, 2003

Related U.S. Application Data

(62) Division of application No. 09/696,208, filed on Oct. 26, 2000, now Pat. No. 6,575,159.
(60) Provisional application No. 60/162,133, filed on Oct. 29, 1999.

(51) Int. Cl.[7] ..... A62B 7/06; F17C 7/02
(52) U.S. Cl. ..... 128/201.21; 128/DIG. 27; 62/50.1; 62/50.2; 62/48.1
(58) Field of Search ..... 128/201.21, 205.22, 128/DIG. 27; 62/50.1, 50.2, 48.1

(56) References Cited

U.S. PATENT DOCUMENTS

| | | | | |
|---|---|---|---|---|
| 2,940,631 A | * | 6/1960 | Keeping | 220/560.1 |
| 2,998,708 A | | 9/1961 | Skinner | |
| 3,364,688 A | | 1/1968 | Matlow et al. | |
| 3,698,200 A | | 10/1972 | Johnson et al. | |
| 3,864,928 A | | 2/1975 | Eigenbrod | |
| 4,211,086 A | | 7/1980 | Leonard et al. | |
| 5,357,758 A | * | 10/1994 | Andonian | 62/45.1 |
| 5,417,073 A | | 5/1995 | James et al. | |
| 5,651,473 A | | 7/1997 | Preston et al. | |
| 5,906,100 A | | 5/1999 | Caldwell et al. | |
| D437,056 S | | 1/2001 | Remes et al. | |
| 6,575,159 B1 | * | 6/2003 | Frye et al. | 128/201.21 |

FOREIGN PATENT DOCUMENTS

| | | |
|---|---|---|
| GB | 1185199 | 3/1970 |
| WO | WO 98/58219 | 12/1998 |

OTHER PUBLICATIONS

PCT/US00/29374, International Search Report.

* cited by examiner

*Primary Examiner*—Henry Bennett
*Assistant Examiner*—Mital Patel
(74) *Attorney, Agent, or Firm*—Hogan & Hartson LLP

(57) ABSTRACT

A portable liquid oxygen (LOX) storage/delivery apparatus is provided, including an insulated LOX container having an interior, a top portion, bottom portion, and sidewall, the sidewall including a first and second side portion, both extending between the top and bottom portion, and a port system in communication with the interior for charging the container and for withdrawing LOX and gaseous oxygen. The gaseous oxygen is withdrawn from the container through a first outlet and LOX is withdrawn from the container through a second outlet when the container is positioned in a first orientation with the sidewall vertically oriented, as well as when the container is positioned in a second orientation with the second side portion oriented downwardly and with the first side portion upwardly and overlying the second side portion, and any position in between.

28 Claims, 3 Drawing Sheets

PORTABLE LIQUID OXYGEN UNIT WITH MULTIPLE OPERATIONAL ORIENTATIONS

CROSS REFERENCE TO RELATED APPLICATION

The present application is a divisional of U.S. application Ser. No. 09/696,208, filed Oct. 26, 2000, now U.S. Pat. No. 6,575,159, which claims priority from U.S. Provisional patent application Ser. No. 60/162,133, filed Oct. 29, 1999. The disclosure of the above-referenced provisional patent application is incorporated herein by reference in its entirety.

BACKGROUND OF THE INVENTION

1. Field of the Invention

The present invention relates generally to a portable liquid oxygen unit.

2. Description of the Background Art

Therapeutic oxygen is the delivery of substantially pure oxygen to a patient in order to facilitate breathing. When a patient suffers from pulmonary/respiratory problems, delivery of oxygen helps the patient get an adequate level of oxygen into his or her bloodstream.

Therapeutic oxygen may be warranted in cases where a patient suffers from a loss of lung capacity. Medical conditions that may make oxygen necessary are chronic obstructive pulmonary disease (COPD), including asthma, emphysema, etc., as well as cystic fibrosis, lung cancer, lung injuries, and cardiovascular diseases, for example.

Related art practice has been to provide portable oxygen in two ways. In a first approach, compressed oxygen gas is provided in a pressure bottle, and the gas is output through a pressure regulator and a hose to the nostrils of the patient. The bottle is often wheeled so that the patient may be mobile. The drawback of compressed, gaseous oxygen is that a full charge of a bottle that is portable does not last very long.

In order to get around this limitation, in a second approach a related art liquid oxygen (LOX) apparatus has been used wherein LOX is stored in a container and the gaseous oxygen that evaporates from the LOX is inhaled by the patient.

The related art LOX apparatus enjoys a longer usable charge than the compressed gas apparatus for a given size and weight, but has its own drawbacks. LOX, being a liquid that is very cold, requires a vacuum-insulated container.

Related art portable LOX units typically are formed with necks that can fill with LOX when tipped, and thus are to be used and carried only in a generally vertical position. This can be impractical at times, such as when driving a vehicle, for example. A vertically positioned related art portable LOX unit is unstable and could potentially cause problems for both the oxygen user and for other drivers if it shifts, slides, or tumbles.

There remains a need in the art, therefore, for an improved portable LOX unit.

SUMMARY OF THE INVENTION

A portable liquid oxygen (LOX) storage/delivery apparatus is provided according to the invention. The portable liquid oxygen (LOX) storage/delivery apparatus comprises an insulated (LOX) container having an interior for containing LOX, the LOX container having a top portion, a bottom portion and a sidewall between the top and bottom portions, the sidewall including a first side portion extending between the top portion and the bottom portion of the container, and a second side portion extending between the top portion and the bottom portion of the container, the second side portion being on an opposite side of the container from the first side portion, a port system in communication with the interior of the container for charging the container with LOX, and for withdrawing LOX and gaseous oxygen from the container, wherein the gaseous oxygen is withdrawn from the container through a first outlet communicating with the interior of the container, the first outlet being located adjacent a first juncture between the top portion and the first side portion of the container; wherein LOX is withdrawn from the container through a second outlet communicating with the interior of the container, the second outlet being located adjacent a second juncture between the bottom portion and the second side portion, and wherein gaseous oxygen can be withdrawn from the container through the first outlet and LOX can be withdrawn from the container through the second outlet when the container is positioned in a first orientation with the sidewall vertically oriented, as well as when the container is positioned in a second orientation with the second side portion oriented downwardly and with the first side portion oriented upwardly and overlying the second side portion, and in all positions in between.

The above and other features and advantages of the present invention will be further understood from the following description of the preferred embodiment thereof, taken in conjunction with the accompanying drawings.

DETAILED DESCRIPTION OF THE PREFERRED EMBODIMENTS

Figure 1:
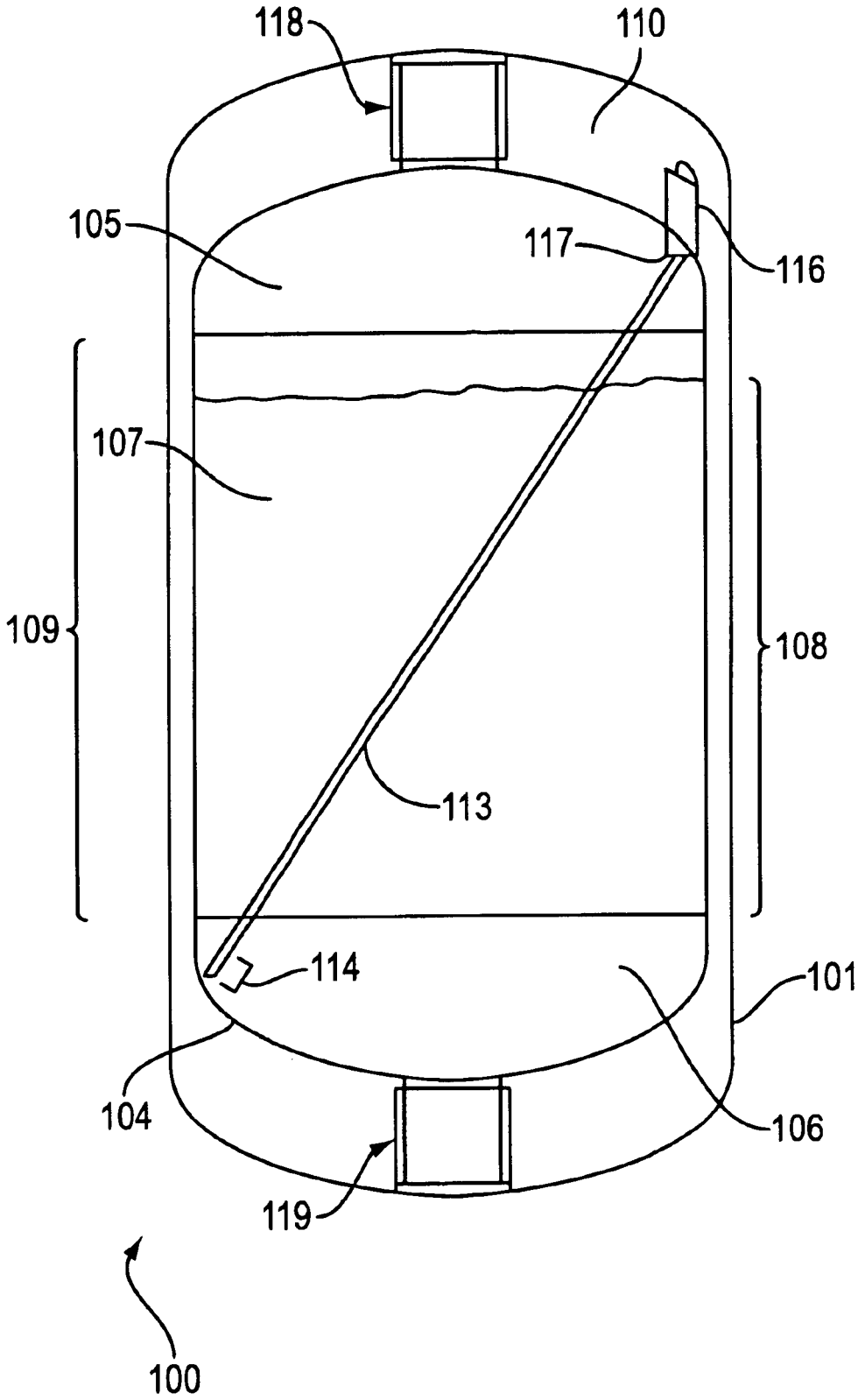
FIG. 1 schematically shows one embodiment of a portable liquid oxygen unit of the present invention in a first position.

FIG. 1 shows one embodiment of a portable liquid oxygen unit 100 of the present invention. The portable LOX unit includes an outer shell 101 and a container 104 within the outer shell 101.

A space 110 exists around the container 104 and is preferably evacuated to at least a partial vacuum. In the illustrated embodiment, the container 104 is held and supported within the outer shell 101 by an optional top support 118 and an optional bottom support 119 (discussed below in conjunction with FIG. 3). The container 104 may be insulated or may be formed of a material having heat insulating properties.

The container 104 is formed of a top portion 105, a bottom portion 106, and a sidewall 107. The sidewall 107 includes a first side portion 108 and a second side portion 109, both extending between the top portion 105 and the bottom portion 106, but with the second side portion 109 being on an opposite side of the container 104 from the first side portion 108.

The container 104 also includes a liquid withdrawal conduit 113 and a gaseous withdrawal conduit 116. The gaseous withdrawal conduit 116 allows withdrawal of gaseous oxygen from the container 104. The gaseous withdrawal conduit 116 enters the container 104 and has a first outlet 117 communicating with an interior of the container 104. The first outlet 117 is located adjacent a first juncture between the top portion 105 and the first side portion 108 of the container 104.

Figure 4:
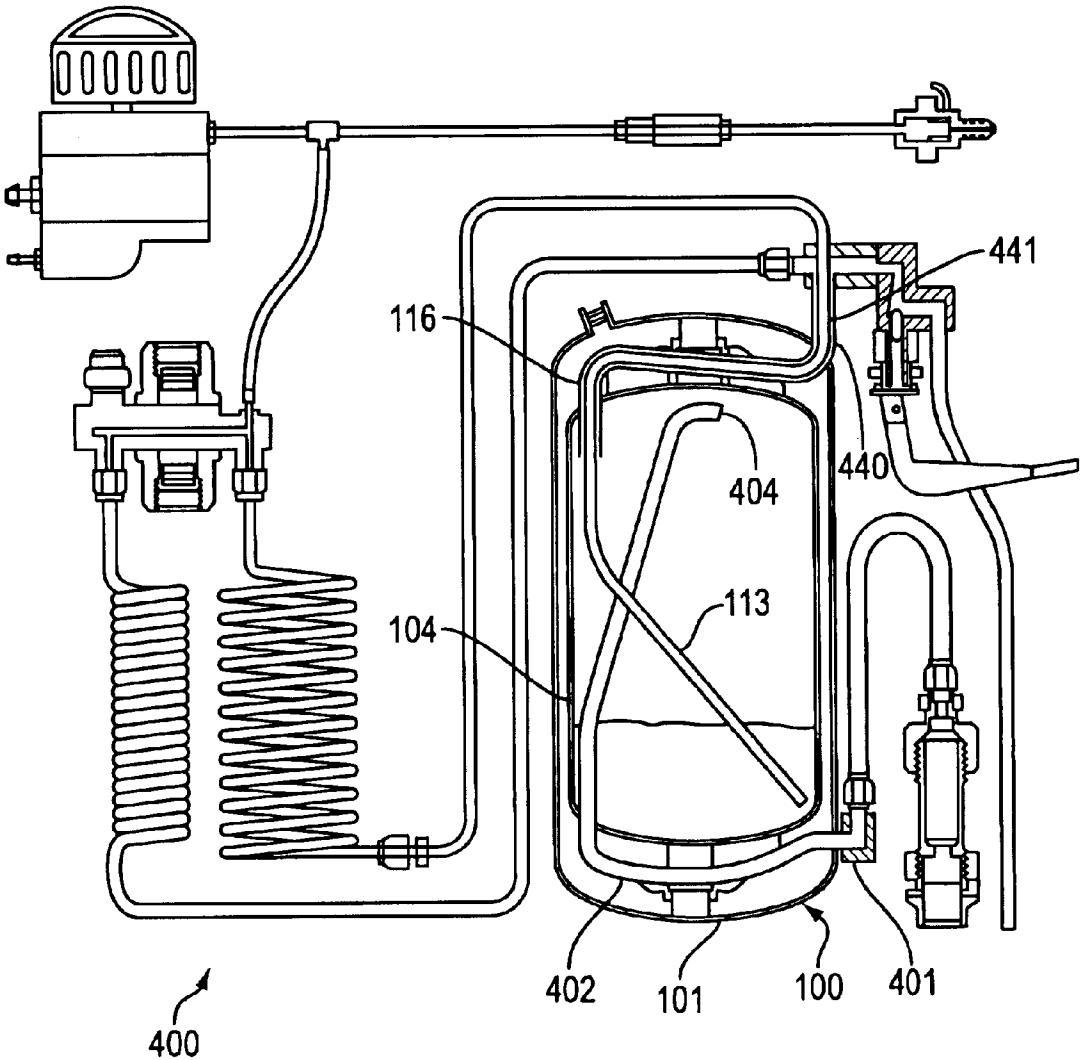
FIG. 4 schematically shows the portable LOX unit of the present invention being used in a portable LOX system.

The gaseous withdrawal conduit 116 exits both the container 104 and the outer shell 101, and forms a first port 440 in the container 104 and in the outer shell 101 (see FIG. 4). The first port 440 is located adjacent the first juncture between the top portion 105 and the first side portion 108 of the container 104.

The liquid withdrawal conduit 113 allows withdrawal of LOX from the container 104. The liquid withdrawal conduit 113 extends diagonally across the interior of the container 104 and has a liquid withdrawal (second) outlet 114 positioned in the bottom portion 106 of the container 104. The second outlet 114 is located adjacent a second juncture between the bottom portion 106 and the second side portion 109. The liquid withdrawal conduit 113 may exit through a second port 441 adjacent the first port 440, with the second port 441 preferably being concentric with the gaseous withdrawal conduit 116 and exiting within the first port 440.

Figure 2:
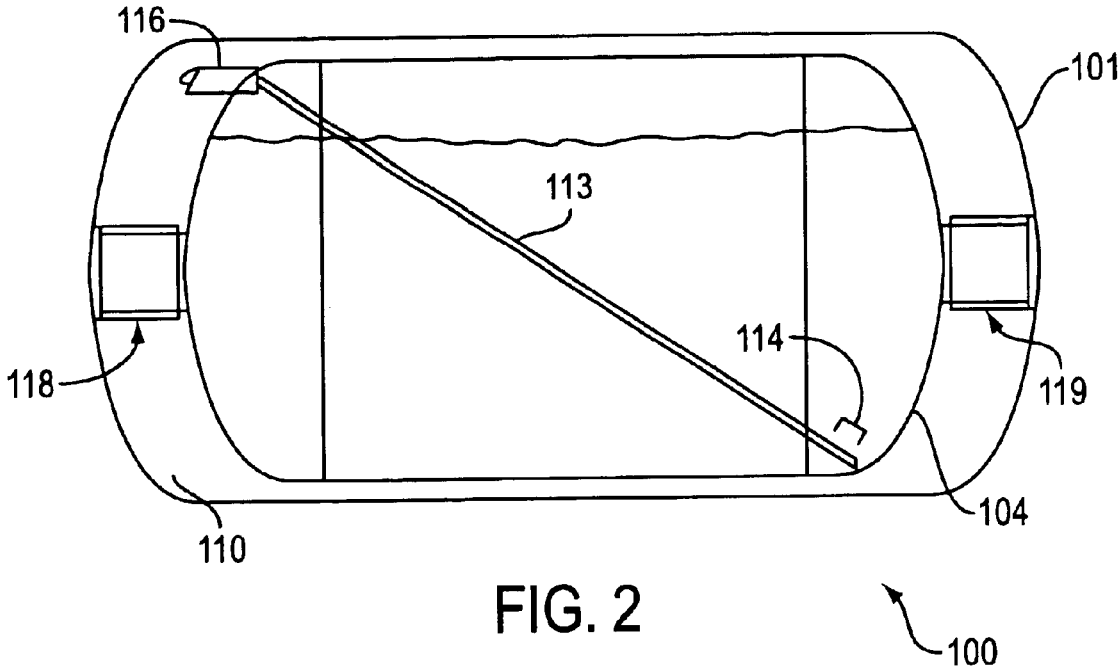
FIG. 2 schematically shows an alternate position of the portable LOX unit illustrating how the portable LOX unit of the present invention may be used in different orientations.

FIG. 2 shows an alternate position of the portable LOX unit 100 illustrating how the portable LOX unit 100 may be used in different orientations. As can be seen from the figure, the second outlet 114 of the liquid withdrawal conduit 113 still resides at a low point of the container 104. It can also be seen from the figure that the first outlet 117 of the gaseous withdrawal conduit 116 remains at a high point in the portable LOX unit 100. Even in a horizontal orientation, the portable LOX unit 100 maintains the liquid withdrawal conduit 113 and the gaseous withdrawal conduit 116 at desired positions to enable both LOX and gaseous oxygen withdrawal. Therefore, the position of the portable LOX unit 100 is not limited by the internal configuration of withdrawal conduits.

Figure 3:
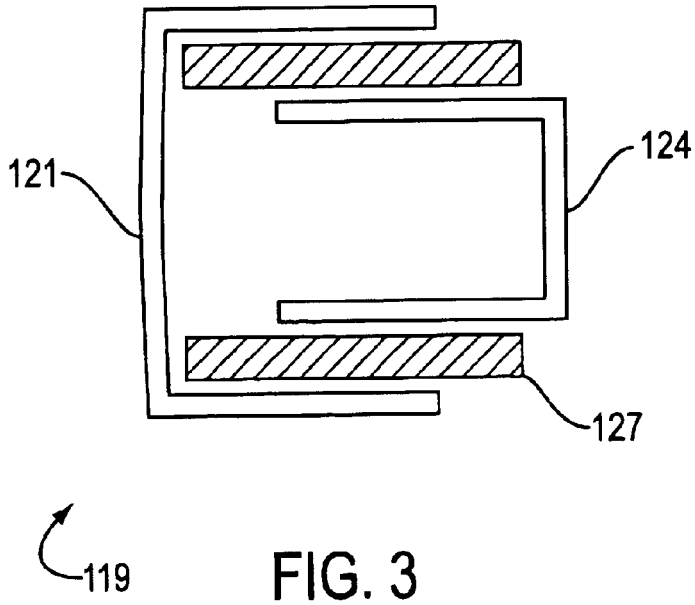
FIG. 3 schematically shows a detail of an insulated support system of the present invention.

FIG. 3 shows a detail of the insulated support system 119. The insulated support system 119 supports and positions the container 104 within the outer shell 101 (see FIGS. 1 and 2). A top insulated support 118 is centrally located on the top portion 105 of the container 104 and extends upwardly from the top portion 105. A bottom insulated support 119 is centrally located on the bottom portion 106 of the container 104 and extends downwardly from the bottom portion 106.

The insulated support system 119 includes an outer shell support 121, a container support 124, and an insulated support 127. The outer shell support 121 is attached to the outer shell 101 (top or bottom), while the container support 124 is attached to the container 104. The insulated support 127 is attached to neither and is merely placed between the two for the purposes of cushioning and insulating. Therefore, the container supports 124 of both the top and bottom insulated support systems 118 and 119 are telescopically received by the respective outer shell supports 121.

It should be noted that the insulated support 127 is preferably made of an insulating material. This is done to minimize heat transfer from the outer shell 101 to the container 104. Due to the insulated support 127, the container support 124 does not come into contact with the outer shell support 121.

FIG. 4 shows the portable LOX unit 100 of the present invention being used in a portable LOX system 400. The portable LOX unit 100 further includes a third port 401 and a LOX delivery conduit 402. The LOX delivery conduit 402 enters the outer shell 101 through a third port 401 and also enters the container 104. The third port 401 is located adjacent a third juncture between the first side portion 108 and the bottom portion 106 (see FIG. 1). The LOX delivery conduit 402 terminates with an open end 404 located within the container 104 and adjacent the top portion 105 of the container 104. Preferably, the open end 404 is centrally located within the top portion 105, so that when LOX is being charged into the container, it flows along the internal sidewall portions of the container so as to minimize turbulence of LOX within the container, thereby facilitating maximal filling of the container with LOX.

Also shown in FIG. 4 is the emergence of the gaseous withdrawal conduit 116 and the liquid withdrawal conduit 113 from the portable LOX unit 100. In this embodiment, both conduits 113 and 116 concentrically emerge from the container 104, and then emerge from the outer shell 101 at the first port 440.

While the invention has been described in detail above and shown in the drawings, the invention is not intended to be limited to the specific embodiments as described and shown.

What is claimed is:

1. A portable liquid oxygen (LOX) storage/delivery apparatus operable in a plurality of orientations, comprising:

an insulated container having an interior for containing LOX, a top portion, and a bottom portion;

a first outlet in communication with the interior of said container for withdrawing gaseous oxygen, said first outlet being located adjacent to said top portion but disposed away from a center of said top portion;

a second outlet in communication with the interior of said container for withdrawing LOX said second outlet being located adjacent to said bottom portion and disposed away from a center of said bottom portion, said second outlet disposed so as to be diagonally opposed to said first outlet;

at least one port in communication with said interior of said container for transporting at least one of LOX and gaseous oxygen from said container;

wherein gaseous oxygen can be removed from said container through said first outlet and LOX can be removed from said container through said second outlet when the portable liquid oxygen (LOX) storage/delivery apparatus is in the plurality of orientations.

2. The apparatus of claim 1, wherein said plurality of orientations includes a vertical orientation, a horizontal orientation wherein said first outlet is oriented above said second outlet, and any position there between.

3. The apparatus of claim 1, wherein said first outlet is disposed maximally away from the center of said top portion.

4. The apparatus of claim 1, wherein said second outlet is disposed maximally away from the center of said bottom portion.

5. The apparatus of claim 1, wherein said first outlet is integrated with said top portion.

6. The apparatus of claim 1, wherein said second outlet is integrated with said bottom portion.

7. The apparatus of claim 1, wherein gaseous oxygen and LOX are transported through a single port.

8. The apparatus of claim 1, wherein gaseous oxygen is transported through a first port and LOX is transported through a second port.

9. The apparatus of claim 8, wherein said first port is substantially concentric with said second port.

10. The apparatus of claim 9, wherein said second port is substantially concentric with said first port and said LOX conduit extends through said first port.

11. The apparatus of claim 1, wherein said first outlet communicates with a first port, said first port being located adjacent said first outlet; and wherein said second outlet communicates with a second port, said second port being located adjacent said first port; said second outlet being connected to said second port by a LOX conduit extending through said interior of said container.

12. The apparatus of claim 1, wherein said first outlet communicates with a first port, said first port being located adjacent said first outlet; and wherein said second outlet communicates with a second port, said second port being located adjacent said second outlet.

13. The apparatus of claim 1, further comprising a delivery port, wherein said container is filled with LOX through said delivery port.

14. The apparatus of claim 13, further comprising a LOX delivery conduit which extends from said delivery port through said interior of said container and terminating at an open end.

15. The apparatus of claim 14, wherein said open end is located adjacent said top portion.

16. The apparatus of claim 15, wherein said open end is centrally located in said container adjacent said top portion.

17. The apparatus of claim 14, wherein said delivery port is located adjacent said bottom portion.

18. The apparatus of claim 17, wherein said delivery port is disposed away from the center of said bottom portion in a similar direction as that of said first outlet.

19. The apparatus of claim 1, wherein said first outlet communicates with a first port, said first port being located through said top portion and horizontally opposed from said first outlet, said first outlet being connected to said first port by a gaseous withdrawal conduit extending through said interior of said container; and wherein said second outlet communicates with a second port, said second port being located adjacent said first port; said second outlet being connected to said second port by a LOX conduit extending through said interior of said container.

20. The apparatus of claim 19, wherein said second port, said second outlet, and said LOX conduit are also used to charge said container with LOX.

21. The apparatus of claim 1, wherein said container is cylindrical.

22. The apparatus of claim 1, wherein said apparatus delivers gaseous oxygen to the nostrils of a patient.

23. The apparatus of claim 22, wherein said apparatus is configured to be carried by said patient.

24. The apparatus of claim 1, wherein said container is insulated by a vacuum between said container and an outer shell wall.

25. A method for allowing operation of a portable liquid oxygen (LOX) storage/delivery device in a plurality of orientations, comprising the steps of:

filling a container with LOX, said container comprising a top portion and a bottom portion;

withdrawing gaseous oxygen from said container through a first outlet, the first outlet in communication with an interior of said container, and said first outlet being located adjacent said top portion and above said LOX when said container is disposed in a non-vertical position;

withdrawing LOX through a second outlet in communication with interior of said container, said second outlet being located adjacent said bottom portion and below said gaseous oxygen when said container is disposed in a non-vertical position, said second outlet disposed so as to be diagonally opposed to said first outlet; and delivering gaseous oxygen to a patient, wherein gaseous oxygen can be withdrawn from said container through said first outlet and LOX can be withdrawn from said container through said second outlet when the portable liquid oxygen (LOX) storage/delivery apparatus is in the plurality of orientations.

26. The method of claim 25, further comprising the step of:

transporting said oxygen gas and said LOX through a port in communication with said interior of said container.

27. The method of claim 25, further comprising the steps of:

transporting said oxygen gas through a first port in communication with said interior of said container; and transporting said LOX through a second port in communication with said interior of said container.

28. The method of claim 27, further comprising the step of:

transporting the LOX for said filling into said container through said second port and second outlet.

* * * * *